US007828241B2

(12) United States Patent
Granger

(10) Patent No.: US 7,828,241 B2
(45) Date of Patent: Nov. 9, 2010

(54) RETAINING END PIECE FOR A ROLL OF WIPING MATERIAL THAT IS DISPOSED ON A WIPING MATERIAL DISPENSING DEVICE

(76) Inventor: Maurice Granger, 17 Rue Marcel Pagnol, 42270 Saint Priest En Jarez (FR)

( * ) Notice: Subject to any disclaimer, the term of this patent is extended or adjusted under 35 U.S.C. 154(b) by 686 days.

(21) Appl. No.: 10/599,415

(22) PCT Filed: Mar. 30, 2005

(86) PCT No.: PCT/FR2005/050197

§ 371 (c)(1),
(2), (4) Date: Feb. 5, 2007

(87) PCT Pub. No.: WO2005/094652

PCT Pub. Date: Oct. 13, 2005

(65) Prior Publication Data

US 2008/0230645 A1 Sep. 25, 2008

(30) Foreign Application Priority Data

Apr. 1, 2004 (FR) ..... 04 50648

(51) Int. Cl.
*B65H 16/06* (2006.01)

(52) U.S. Cl. ..... 242/599.3; 242/596.7

(58) Field of Classification Search ..... 242/599, 242/599.3, 596.7, 597.5, 598.3
See application file for complete search history.

(56) References Cited

U.S. PATENT DOCUMENTS

| | | | | |
|---|---|---|---|---|
| 3,690,580 | A * | 9/1972 | Jespersen | 242/599.3 |
| 4,307,639 | A | 12/1981 | DeLuca | |
| 5,495,997 | A * | 3/1996 | Moody | 242/599.3 |
| 5,669,576 | A * | 9/1997 | Moody | 242/599.3 |
| 5,997,195 | A | 12/1999 | Burgin | |
| 6,082,664 | A * | 7/2000 | Phelps et al. | 242/599.3 |
| 6,402,085 | B1 * | 6/2002 | Smith | 242/599.3 |
| 6,824,091 | B2 * | 11/2004 | Inana | 242/596.7 |
| 2005/0230514 | A1 * | 10/2005 | Inana et al. | 242/599.3 |

FOREIGN PATENT DOCUMENTS

| | | |
|---|---|---|
| DE | 627094 | 3/1936 |
| DE | 8912053 | 2/1990 |
| WO | WO9623719 | 8/1996 |

* cited by examiner

*Primary Examiner*—William A Rivera
(74) *Attorney, Agent, or Firm*—Heslin Rothenberg Farley & Mesiti P.C.

(57) ABSTRACT

An endpiece which forms an integral part of a mandrel used to support a roll of material engages a guide. The endpiece comprises a cylindrical part which can be inserted into the mandrel, a collar which rests against a facing surface of the endpiece, and a projecting attachment. A guiding and retaining groove is provided along the length of the projecting attachment to form a guide path. A cooperating guide is provided on a bracket that supports the roll of material. The guide is disposed on an inner side of the bracket and comprises slightly-projecting flats which form and define a channel to receive the projecting attachment of the endpiece as so enable the endpiece to be inserted and retained therein. The channel extends into a part for receiving the endpiece following the insertion thereof.

11 Claims, 4 Drawing Sheets

Figure 1:
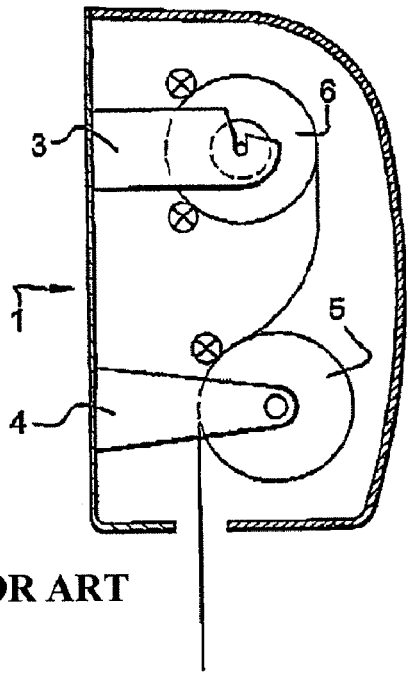

RETAINING END PIECE FOR A ROLL OF WIPING MATERIAL THAT IS DISPOSED ON A WIPING MATERIAL DISPENSING DEVICE

CROSS REFERENCE TO RELATED APPLICATION

This is a 371 filing of International Application PCT/FR2005/050197, filed Mar. 30, 2005, and published, in French, as International Publication No. WO 2005/094652 A1 on Oct. 13, 2005, and claims priority of French Application No. 0450648, filed on Apr. 1, 2004, which applications are hereby incorporated by reference herein, in their entirety.

BACKGROUND ART

The invention relates to the technical field of dispensers of quilted papers, with automatic or non-automatic cutting. These dispensers can have different applications, such as toilet paper, paper towels and the like.

The applicant has developed numerous wiping material dispensers which comprise a housing (1) with a protective cover (2), inside which are arranged, mounted on side brackets (3-4), a drum (5) accommodating an internal cutting device which is activated when the user pulls the web of material from a reel of material (6). This reel may be hung from the side brackets, or rest directly on the drum. The reel of wiping material is wound tightly onto a core. This core (7) takes two shaped endpieces (8), one at each end, that can be positioned on the brackets (3) of the housing. These endpieces are generally made in a cylindrical shape with a discoidal part (8*n*) with an overhang (8*a*) designed to bear against the adjacent face of the core, the said discoidal part comprising a smooth cylindrical appendage (8*b*) designed to be positioned in a slot (3*a*) formed on the adjacent bracket in question. This type of endpiece (8) is simple to make and merely rests in the slot formed in the bracket (3) without other means of retention.

The problem that arises is the fact that at the end of the reel (6) the reel weighs much less, because of the reduction of its thickness, and if the user pulls sharply on the end (6*a*) of the projecting part of the material to cut it off, this may have an indirect effect on the said reel of material which can be significantly raised and can have an indirect effect on the corresponding transmission of force.

In such a situation it can happen that the reel (6) of material is able to escape from its intended position (3*a*) on the brackets (3), bringing about an escape effect. The reel of material may therefore fall into the bottom of the dispenser and thus impede or prevent its operation.

SUMMARY OF THE INVENTION

The applicant's approach has therefore been to seek a solution to this difficulty and ensure that the reel of material continues to be held in position even when nearly fully unwound.

Another aspect of the invention was to devise an endpiece specifically designed to fulfill the intended objectives, since no use of the prior-art endpiece can be used with the embodiment provided by the invention.

Another aspect of the invention was to devise a novel endpiece that would solve the problems posed, in an inexpensive embodiment, and a possible additional cost that would be insignificant compared with the production of endpieces according to the prior art, by also providing, in addition, special features on the bracket or brackets of the dispenser housing that will not create excessive additional costs in the implementation.

Another aspect was to devise an endpiece and special features for the brackets of the housing that will allow automatic removal of the reel when fully unwound, when the dispenser cover is opened.

These and yet other aspects will become clear as the description proceeds.

A first feature of the invention is that the endpiece integrated into a core for a reel of material, of the type comprising a cylindrical part engageable in the said core and a collar that bears against the adjacent face of the endpiece, having a projecting overhanging appendage, the said projecting appendage being provided along its length with a guiding retention groove able to act as a guide path, is noteworthy in that it engages with a guide formed on the bracket supporting the reel of material adjacent to the dispenser housing, and in that the said guide is on the inside of the bracket on the side on which it can accept the reel of material and the drum of the corresponding cutting device, and in that the guide has special slightly raised lands forming and defining a channel able to accommodate the appendage of the endpiece for the passage and retention of the endpiece and continued by a part that accommodates the endpiece after insertion.

These and also other features will become clear as the description proceeds.

BRIEF DESCRIPTION OF THE DRAWING FIGURES

Figure 2:
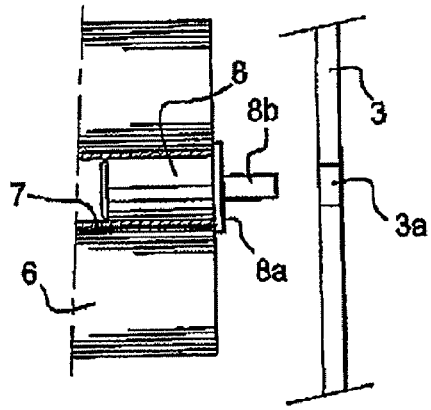
PRIOR ART Fig. 2
Figure 3:
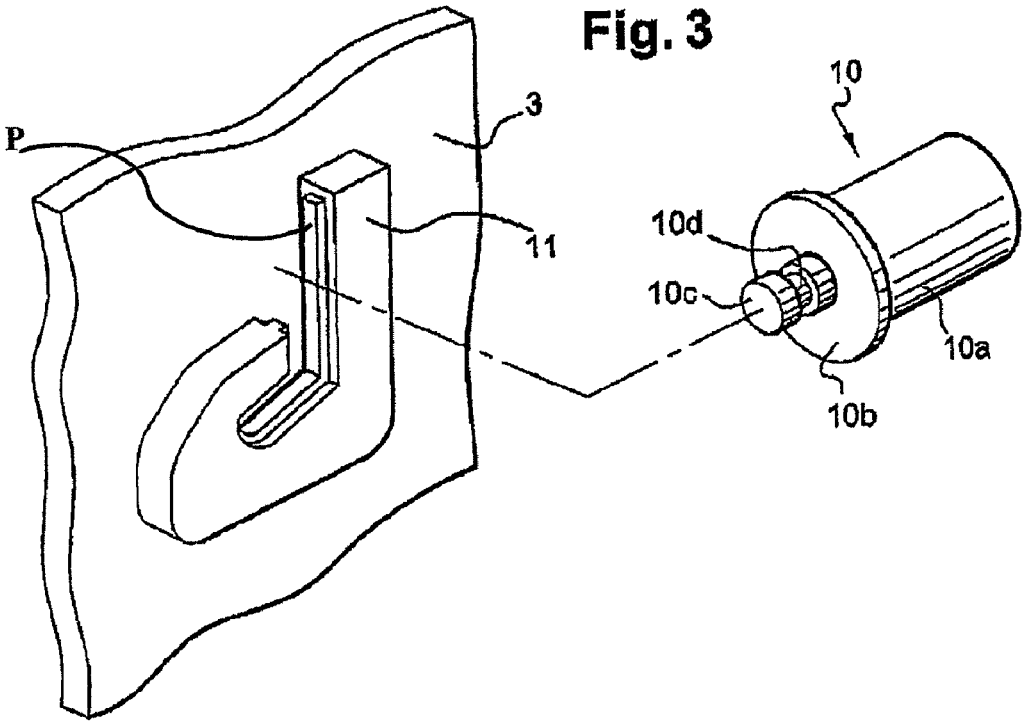
PRIOR ART Fig. 3
Figure 4A:
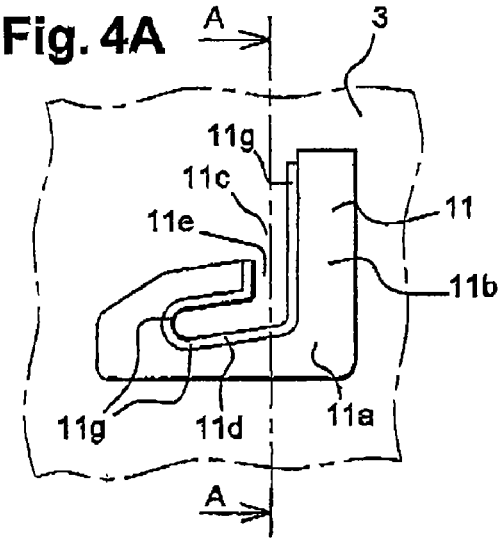
Figure 4B:
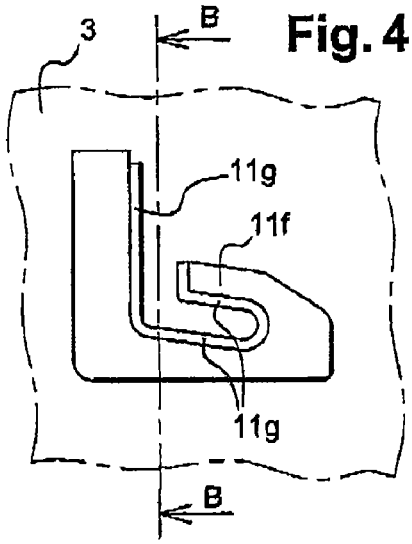
Figure 4C:
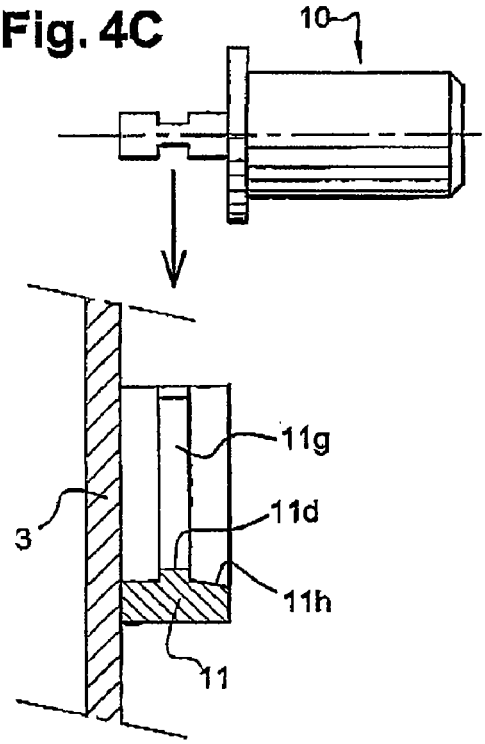
Figure 4D:
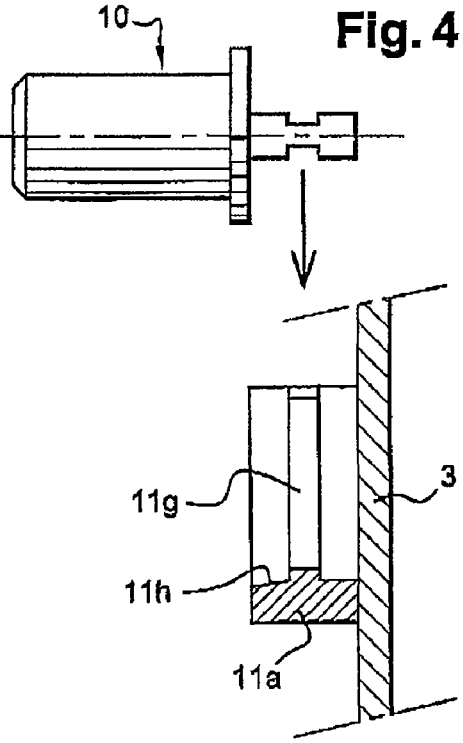
Figure 5:
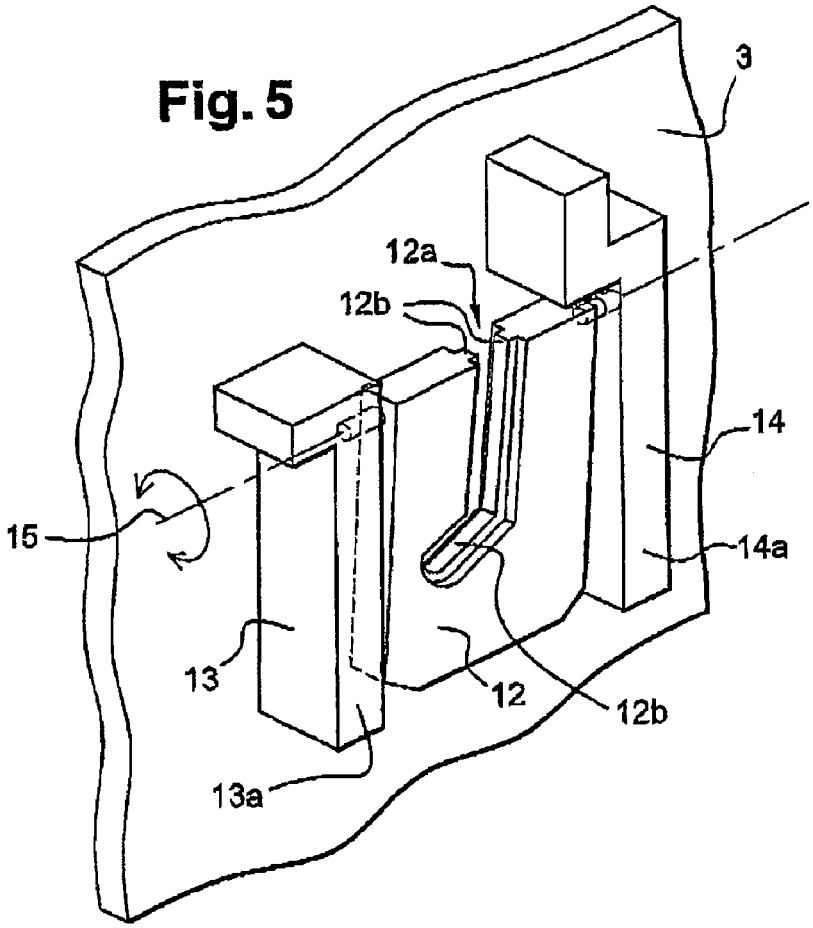
Figure 6:
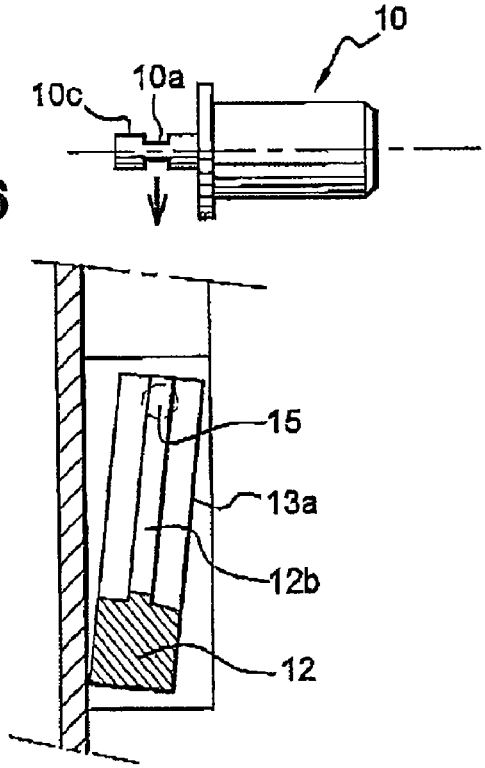
Figure 7:
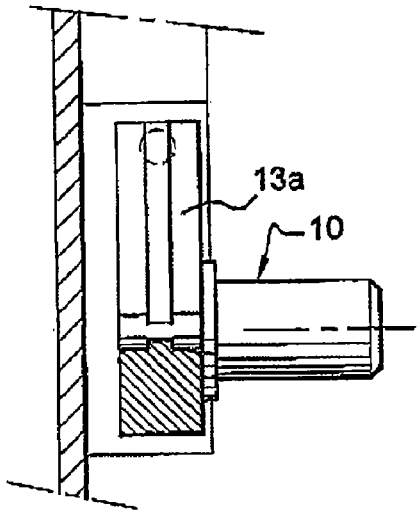
Figure 8:
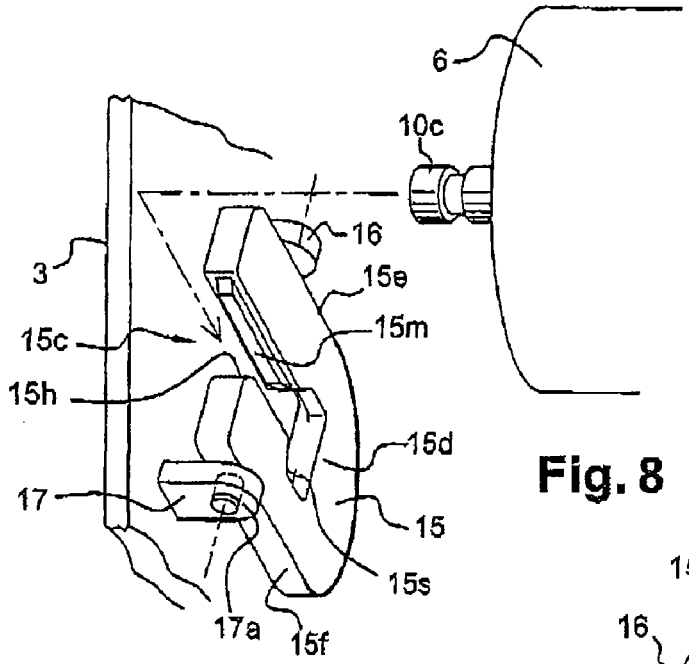
Figure 11:
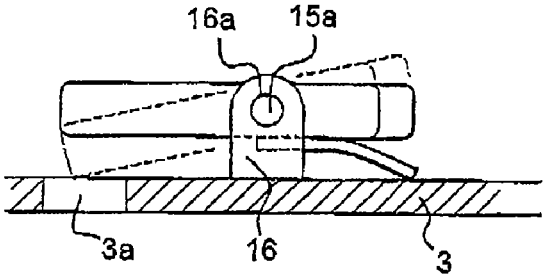
Figure 9:
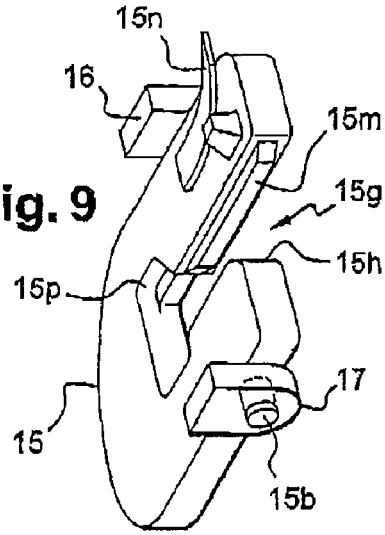
Figure 10:
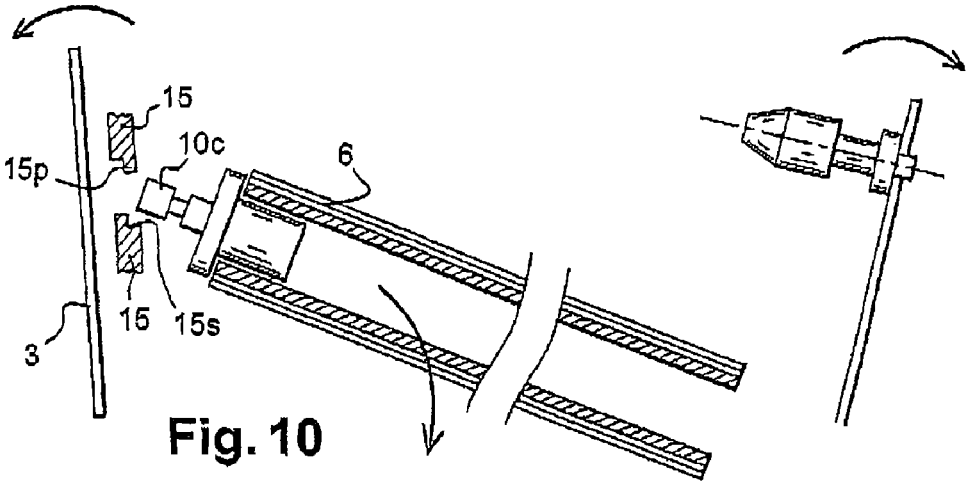

In order to provide a clear idea of the subject of the invention, it is illustrated in a non-restrictive manner in the figures of the drawings, in which:

FIG. 1 is an example of a wiping material dispenser with a reel of material hanging from the drum, the reel being placed on a core to which endpieces according to the prior art are fitted, FIG. 2 is a partial large-scale view showing an endpiece according to the prior art in the core of the reel of material, FIG. 3 is a perspective view showing the endpiece according to the invention and its connection to a supporting guide, in a first variant, FIGS. 4*a* and 4*b* are partial views of brackets, right-hand and left-hand housing, to which a shaped guide is attached to take the improved endpiece, FIGS. 4*c* and 4*d* are cross sections, taken on A.A and B.B, respectively, of FIGS. 4*a* and 4*b*, showing the internal profile of the guide according to the invention, FIG. 5 is a view of a variant showing the positioning of a guide forming a swinging flap which takes the endpiece according to the invention and is arranged between projecting blocks set on either side and attached to the supporting brackets, FIG. 6 is a partial view showing the positioning of the endpiece in the second variant, FIG. 7 is a view similar to FIG. 6 showing the position of the endpiece in the flap, FIG. 8 is a view of a third variant of the design of the brackets of the housing taking in the endpiece according to the invention. This view is a view of the inward side of the bracket of the dispenser, FIG. 9 is a view of the third variant shown in FIG. 8 with a view of the outward side of the bracket of the dispenser, FIG. 10 is a top view, in accordance with FIGS. 8 and 9, and FIG. 11 is a partial view, in accordance with FIG. 8, illustrating the pivoting of the reel at the end of the web and when pivoting begins.

DETAILED DESCRIPTION

In order to render the subject of the invention more concrete, it will now be described in a non-restrictive manner illustrated in the figures of the drawings.

The endpiece according to the invention is marked (10) and comprises, as in the prior art, a cylindrical bearing surface (10*a*) engageable in the core (7) of the reel of material, and a discoidal face (10*b*) which is pressed against the end surface of the core in question.

According to the invention, the appendage (10*c*) comprises, in its thickness and along its length, a groove (10*d*) forming a guide path. This groove can fit into a mating profile (P) on a means (11-12-15) forming a guide fixed to or pivoted on the bracket or brackets (3) supporting the reel of material adjacent to the housing (1) of the wiping material dispenser.

Referring to the first variant shown in FIGS. 4*a* to 4*d*, the guide (11) is fixed because it is shaped directly by moulding it with the bracket (3). This guide (11) is on the inside of the bracket (3) on the side on which it can accept the reel of material (6) and the drum (5) of the corresponding cutting device. The guide (11) is thus specially shaped to form and define a generally L-shaped channel able to accommodate the appendage (10*c*) of the endpiece of the invention. The guide (11), in the version shown in FIGS. 4*a* to 4*d*, comprises a base (11*a*) which is continued on one side by a vertical leg (11*b*) defining a slot (11*c*) shaped as a channel for the passage and retention of the endpiece. The configuration of the slot is advantageously of a bayonet design with a vertical part and a horizontal or appreciably inclined part (11*d*) in the thickness of the base. The neck (11*e*) formed between the vertical leg and the nose (11*f*) in the upper part of the base (11*a*) allows the appendage (10*c*) of the endpiece to pass through. In accordance with one provision of the invention, along the outline of the leg (11*b*) and of the base (11*a*) the central part (11*g*) has a slightly raised land whose width corresponds in practice to the width of the groove formed on the appendage of the endpiece. It can thus be seen that, in this embodiment, the endpiece is positioned correctly by the engagement and connection between this land and the grooved part of the appendage of the said endpiece, and appropriate guiding is made possible.

Also advantageously, the neck (11*e*) may be slightly pinched so that a slight push is required, downwards or upwards, on the endpiece and associated core and reel, depending on whether the endpiece is being inserted or withdrawn to change the reel.

In this embodiment, therefore, the special shaping of the appendage of the endpiece, and that of the guide formed on the bracket, ensure that the reel cannot escape transversely because it is held by the connection between the rib or raised land and its groove. Sideways movement is therefore prevented. The endpiece must necessarily be raised and withdrawn from its seat, and this greatly improves the reliability of the unit when in use. The guide (11) has been shown on the right or on the left, as shown in FIGS. 4*a* and 4*b*.

Another provision is that the lower part of the base may have an oblique lip (11*h*) on the outward side, while the inner surface is horizontal.

Hence, with this supplementary provision of the invention, and in order to prevent any risk of an endpiece of the prior art being used, the base of the guide can be so constructed in the horizontal and/or oblique part of the channel of the base part that the oblique lip (11*h*) faces outwards, so that any undesired endpiece necessarily falls out of the seat.

In another, significantly more complicated embodiment of the invention, as shown in FIGS. 5 to 7, the guide (12) is made in the form of a swinging flap between two blocks (13-14) projecting from and moulded with the brackets (3). The flap guide (12) is in the form of a channel with a corresponding slot (12*a*) constructed as in the previous embodiment with, in the thickness of the flap, a projecting form (12*b*) whose width is exactly equal to the width of the groove formed in the appendage of the endpiece.

The flap guide (12) produced in this way rotates about an axis (15) between the two support blocks (13-14), with a slight gap between it and the adjacent face of the bracket (3) in question, this gap being represented by (d). The visible faces (13*a*-14*a*) of the two blocks (13-14) supporting the flap guide can act as bearing faces for the discoidal part of the endpiece of the invention.

In the initial positioning phase, the flap is swung away, as shown in FIG. 6, and its bottom face (12*d*) contacts the wall of the bracket (3). The insertion of the appendage (10*c*) of the endpiece (10) into the flap guide (12) causes its discoidal part to contact the front bearing faces (13*a*-14*a*) of the two blocks (13-14) positioned on either side of the flap guide and thus pivots the said flap to the vertical until the endpiece (10) has reached the bottom. This kind of arrangement is highly advantageous because it ensures reliable insertion of the endpiece (10) because of the fact that the connection and engagement produced between the flap guide, owing to the rib formed by its inward land, and the groove in the appendage of the endpiece causes, by this engagement, the flap to pivot as the endpiece descends. Should the endpiece used not correspond to that of the invention, meaning that it has a smooth appendage with no other configuration, there would therefore be no action tending to return the said flap guide to the vertical because of the absence of connection and engagement, and the core would therefore fall down inside the corresponding interior housing of the dispenser.

As shown in the first variant, and as seen in FIGS. 6 and 7, the lower part of the flap guide has an oblique lip, on the outward side, while the line on the other side of the central part is horizontal.

The invention thus ensures reliable insertion of the reel of material, however much or little it may have been unwound.

Referring now to the third variant illustrated in FIGS. 8 to 11, here the endpiece constructed in accordance with the invention engages with another means (15) attached to the side brackets (3) of the housing to provide not only the functions indicated above, but also to allow, in combination with the said new means, the reel to escape when the material is exhausted when the dispenser cover is opened. For this purpose, this means (15) is pivoted on the inner bracket (3) against two lugs (16-17) fixed or moulded to the said bracket, these lugs having, for example, openings (16*a*-17*a*) allowing the engagement of two pins (15*a*-15*b*) formed and situated in opposition on the said means (15). This means (15) is U-shaped with the open zone (15*c*) directed upwards for the insertion of the appendage (10*c*) of the endpiece (10) and its closed portion (15*d*) directed downwards, the means (15) being inclined at an angle. Thus, the two pins (15*a*-15*b*) are situated on the outer edges (15*e*-15*f*) of the said means. The latter also contains a channel (15*g*) in its central portion continuing from the access opening (15*c*) for the guided insertion of the endpiece (10) by its appendage, and thus for the installation of the reel of material. The inside faces (15*h*-15*m*) defining the slot (15*g*) constitute the guide path for the endpiece, particularly for the appendage (10*c*) and for its guiding and retention groove (10*d*). More specifically, the width of the lower inside face (15*h*) is such as to be substantially less than the dimension of the groove in order to ensure good retention. On the other hand, the other, upper, inside face (15*m*) is narrower, while still contributing to the said retention of the endpiece.

Also, the pivoting of the means (15) relative to the bracket, during insertion of the appendage (10*c*) of the endpiece, when the reel of material is being installed, occurs in opposition to the action of a tongue (15*n*) which is connected to the means (15) at its fixed end and is capable of elastic deflection so as to make contact with the adjacent inside face of the bracket (3), in a manner that is similar to and equivalent to the implementation of the second variant. The said bracket (3) has a cutout (3*a*) to allow the passage of the end of the means (15) in a stress-free situation, that is to say when there is no reel of material installed.

In accordance with one particular provision of this means (15), this means is constructed to allow the reel of material to pivot and escape in a particular situation which is that relating to the opening of the dispenser cover. The dispenser can in fact be fitted, as taught in patent application FR 04.51830 by the Applicant, with a wiping reel loading device in which the reel is put in position when the cover is closed. For this purpose the side brackets between which the reel is mounted are constructed with specific means and the said brackets themselves have an ability to flex and pivot, so as to draw apart when the cover is opened and reposition themselves in a plane perpendicular to the rear face of the housing when the cover is closed and thus hold the reel of wiping material in position.

To this end, the means (15), in this embodiment, must be able to allow the reel of material to pivot and escape when the said cover of the dispenser is opened, due to the reel support bracket moving away.

To this end, the means (15) is thus constructed in its closed portion and on each side of the longitudinal slot with two opposite recesses (15*p*-15*s*), an upper recess (15*p*), on the outward side of the means (15) adjacent to the bracket, and a lower recess (15*s*), on the inward side of the means (15) next to the reel. With this embodiment it is therefore possible, when the two reel support brackets move apart, to release the reel which can swing down, away from the reception of the means (15) on the other bracket, and thus be brought clear of the said means (15). This is because the recesses (15*p*-15*s*) are formed in such a way as to allow the reel and its associated specific endpiece to become oriented in an angular plane allowing escape from the plane of retention of the endpiece appendage, and thus allow it to escape with the said reel by sliding downwards.

The means (15) thus constitutes the optimized version for locking in position the endpiece and the reel of wiping material but also for discharging the reel when the dispenser cover is opened for the purposes of changing the reel or for any other operation.

The advantages are clear from the invention. It is worth stressing the simplicity of the concept and the complete absence of any additional cost of manufacture because the parts are formed directly in the moulding of the components of the endpiece and of the corresponding bracket. In the last version, only the addition of an extra flap, and its installation, are necessary.

The invention claimed is:

1. An endpiece integrated into a core for a reel of material, the endpiece comprising a cylindrical part engageable in said core, a collar that bears against an adjacent face of the core, and a projecting overhanging appendage, the projecting appendage being provided along its length with a guiding retention groove to act as a guide path, in combination with a guide formed on a bracket supporting the reel of material adjacent to a dispenser housing, and wherein said guide is on an inside of the bracket on a side on which the guide can accept the reel of material, and wherein the guide has raised lands forming and defining a generally L-shaped channel to accommodate the appendage of the endpiece for the passage and retention of the endpiece, and the guide is continued by an upper part that overlies the endpiece after insertion of the appendage in the guide, wherein the guide comprises a base which is continued on one side by a vertical leg defining a slot forming the generally L-shaped channel for the passage and retention of the endpiece, and, along an outline of the leg and of the base, a central part of the guide has the raised lands, and width of the raised lands corresponds to a width of the groove formed on the appendage of the endpiece, wherein configuration of the slot is of a bayonet design, and a neck formed between the vertical leg and a nose of the upper part allows the appendage of the endpiece to pass through, and wherein a lower part of the base has an oblique lip, on an outward side, while a surface on an other side of the central part is horizontal.

2. The combination according to claim 1, wherein the guide is made in a fixed manner, being shaped directly by being moulded with the bracket.

3. An endpiece integrated into a core for a reel of material, the endpiece comprising a cylindrical part engageable in said core, a collar that bears against an adjacent face of the core, and a projecting overhanging appendage, the projecting appendage being provided along its length with a guiding retention groove to act as a guide path, in combination with a guide rotatably mounted on a bracket supporting the reel of material adjacent to a dispenser housing, and wherein said guide is on an inside of the bracket on a side on which the guide can accept the reel of material, and wherein the guide has raised lands forming and defining a channel to accommodate the appendage of the endpiece for the passage and retention of the endpiece, and a width of the raised lands corresponds to a width of the groove on the appendage of the endpiece, and wherein the guide comprises a swinging flap between two support blocks projecting from and moulded with the bracket, and the channel comprises a slot in a thickness of the flap.

4. The combination according to claim 3, wherein the flap rotates about an axis between the two support blocks, with a slight gap between the flap and an adjacent face of the bracket, and front visible faces of the two blocks act as bearing faces for a discoidal part of the endpiece.

5. The combination according to claim 4, wherein in an initial positioning phase, the flap is swung away, and a bottom face of the flap contacts a wall of the bracket, and the insertion of the appendage of the endpiece into the guide causes the discoidal part to contact the front bearing faces of the two blocks positioned on either side of the flap and thus pivots the flap to the vertical until the endpiece has reached a bottom of the channel, and connection and engagement produced between the guide, owing to the lands, and the groove in the appendage of the endpiece causes, by this engagement, the flap to pivot as the endpiece descends.

6. The combination according to claim 4, wherein a lower part of the guide has an oblique lip, on an outward side of a central part, while a surface on an other side of the central part is horizontal.

7. An endpiece integrated into a core for a reel of material, the endpiece comprising a cylindrical part engageable in said core, a collar that bears against an adjacent face of the core, and a projecting overhanging appendage, the projecting appendage being provided along its length with a guiding retention groove to act as a guide path, in combination with a guide rotatably mounted on a bracket supporting the reel of material adjacent to a dispenser housing, and wherein said guide is on an inside of the bracket on a side on which the guide can accept the reel of material, and wherein the guide has raised lands forming and defining a channel to accommodate the appendage of the endpiece for the passage and retention of the endpiece, and a width of the raised lands corresponds to a width of the groove on the appendage of the endpiece, and wherein the guide is pivoted on an inner bracket supporting the reel of material adjacent to the dispenser housing, against two lugs fixed or moulded to the bracket, the lugs having openings allowing engagement of two pins formed and situated in opposition on said guide, and the guide is U-shaped with an open zone directed upwards for the insertion of the appendage of the endpiece and a closed portion directed downwards, the guide being inclined at an angle, and the two pins being situated on outer edges of the guide, and the guide contains a slot in a central portion continuing from an access opening for the guided insertion of the endpiece by the appendage, and thus for installation of the reel of material.

8. The combination according to claim 7, wherein inside faces defining the slot constitute a guide path for the appendage and for the guiding retention groove, and width of a lower inside face is substantially less than a dimension of the grove, and an other, upper, inside face is narrower.

9. The combination according to claim 7, wherein pivoting of the guide relative to the bracket, during insertion of the appendage of the endpiece, when the reel of material is being installed, occurs in opposition to action of a tongue which is connected to the guide at a fixed end of the guide and is capable of elastic deflection so as to make contact with an adjacent inside face of the bracket.

10. The combination according to claim 7, wherein said bracket has a cutout to allow passage of an end of the guide when there is no reel of material installed.

11. The combination according to claim 7, wherein the guide is constructed in the closed portion and on each side of the slot with opposite recesses, namely, an upper recess, on an outward side of the guide adjacent to the bracket, and a lower recess, on an inward side of the guide adjacent to the reel, and the recesses are formed in such a way as to allow the reel and associated endpiece to become oriented in an angular plane allowing escape from a plane of retention of the endpiece appendage, and thus allow the end piece to escape with the reel by sliding downwards.

* * * * *